United States Patent [19]

Knutson

[11] 4,401,259

[45] Aug. 30, 1983

[54] COIN BANK

[75] Inventor: Darryl C. Knutson, Medicine Lake, Minn.

[73] Assignee: Toystalgia, Incorporated, Golden Valley, Minn.

[21] Appl. No.: 215,244

[22] Filed: Dec. 11, 1980

[51] Int. Cl.[3] ..... A45C 1/12; A63H 33/34

[52] U.S. Cl. ..... 232/4 R; 46/2

[58] Field of Search ..... 232/1 D, 4 R, 43.2; 46/2, 4

[56] References Cited

U.S. PATENT DOCUMENTS

| | | | |
|---|---|---|---|
| Re. 24,355 | 9/1957 | Whalen | 46/2 |
| D. 156,365 | 12/1949 | O'Malley . | |
| 1,242,820 | 10/1917 | Levay et al. | 232/4 R |
| 1,568,577 | 1/1926 | Sykes | 232/4 R |
| 1,756,048 | 4/1930 | Williams . | |
| 2,448,807 | 9/1948 | Kimball . | |
| 2,606,394 | 8/1952 | Janiak | 232/4 R X |
| 2,618,892 | 11/1952 | Locks et al. . | |
| 2.650,452 | 9/1953 | Martin | 232/4 R X |
| 2,933,853 | 4/1960 | Laval, Jr. . | |
| 2,955,752 | 10/1960 | Thomas | 46/2 |
| 3,044,232 | 7/1962 | Robichaud | 46/2 |
| 3,105,612 | 10/1963 | Krasnoff et al. . | |
| 3,831,313 | 8/1974 | Cichy | 46/2 |
| 4,345,400 | 8/1982 | Katzman et al. | 46/4 |

*Primary Examiner*—Robert P. Swiatek

*Attorney, Agent, or Firm*—Merchant, Gould, Smith, Edell, Welter & Schmidt

[57] ABSTRACT

A coin bank resembling a bird is disclosed. The bank includes a hollow, egg-shaped container (11) for receiving the deposited coins. A covering (12) having attachments (21–25) resembling the features of a bird encases the container (11). Coins are deposited in the bank (10) through aligned passageways (15, 16) in the covering (12) and container (11) respectively. The container (11) is inserted into and removed from the covering (12) through an adjustable opening (13) located in a bottom portion of the covering (12).

1 Claim, 6 Drawing Figures

COIN BANK

TECHNICAL FIELD

The present invention relates to coin banks and in particular to coin banks constructed in the likeness of an animal or a bird.

BACKGROUND OF THE INVENTION

Prior art coin banks include banks structured as toys, animal shaped banks which when filled expand in certain body portions for amusement purposes, coin banks providing elements for packaging the deposited coins and animal shaped banks which have a coin dispensing mechanism. An example of a coin dispensing bank is taught in U.S. Pat. No. 2,955,752 to L. M. Thomas illustrating an upstanding body of a chicken wherein coins are deposited into a hollow portion of the body. Downward force exerted on the chicken's body actuates a coin dispensing means which then releases or drops a coin from the lower area of the body.

The present invention, although having a bird or fowl likeness, differs from the prior art in that the bank does not dispense with the deposited coins as "laid eggs", but rather contains the coins in an egg-shaped container portion which is removed in its entirety from the bird-like covering much like a single-laid egg. Coins can then be retrieved from the removed egg-portion without requiring a mechanical apparatus for dispensing the coins as in the prior art.

SUMMARY OF THE INVENTION

The present invention of a coin bank is constructed in the likeness of a bird or other egg-laying animal. The bank has a hollow, oval-shaped container for the coins which container can be inserted or removed from a covering conforming to the egg-shape. The covering includes a portion having an adjustable bottom opening for the insertion or removal of the coin container. Both the covering and the container have passageways aligned together through which coins are deposited past the covering into the hollow interior of the egg-shaped container.

According to one aspect of the invention, the covering is constructed with attachments including eyes, wings ,feet, a beak, and feathers or a comb such that the bank resembles a bird or other egg-laying animal.

Another aspect of the invention provides an adjustable opening in the covering which allows the egg container to be inserted into the bird-like covering for the depositing of coins therein and which also allows the egg-like container to be removed from the covering to symbolize the laying of an egg by the bird-like bank.

Another aspect of the present invention allows the removal of the coins deposited into the bank through the same passageway by which the coin was first deposited into the egg-like container.

A further aspect of the present invention is to provide a coin bank which not only serves the useful function of retaining deposited coins but serves also as an aesthetic and amusing method for saving coins.

DETAILED DESCRIPTION OF THE PREFERRED EMBODIMENT

Figure 2:
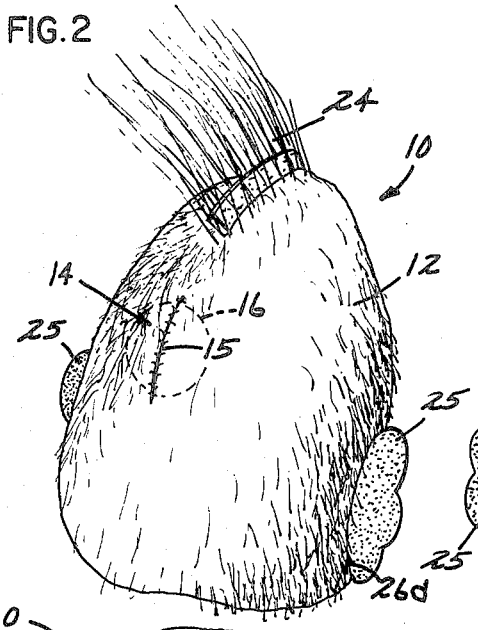
FIG. 2 is a perspective view of the present invention as viewed from the rear of the invention.

Referring now to the drawings, like reference numerals are used throughout the several views to indicate identical elements of the invention.

Figure 1:
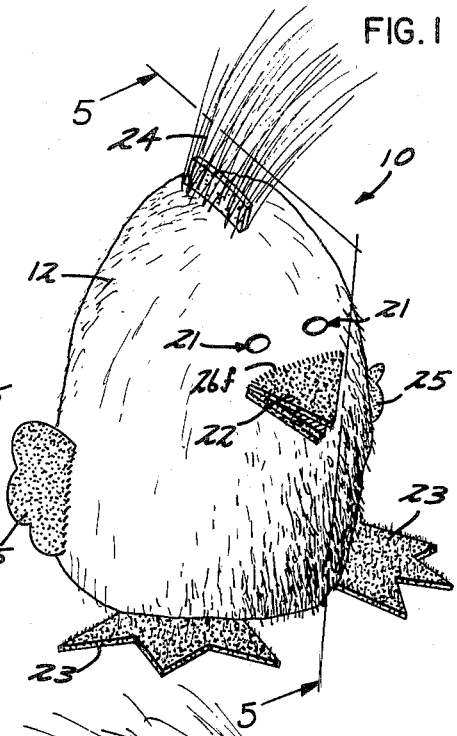
FIG. 1 is a perspective view of the present invention as viewed from the front.

The coin bank 10 is constructed to resemble a bird or other egg-laying animal as can be seen in the perspective view of FIG. 1. The bird-like bank 10 is an upright structure which can symbolize either a standing bird or a bird positioned as if ready to lay an egg. A hollow, oval-shaped container for the coins fills the interior area of the bank. The exterior of the bank is a covering 12 made from a cloth with a feathery or down-like texture. Secured at various locations on the covering are attachments which include in this embodiment a comb-like element 24 atop the bank 10, a pair of eyes 21, a beak-like element 22, a pair of feet 23, and a pair of wings 25.

Figure 3:
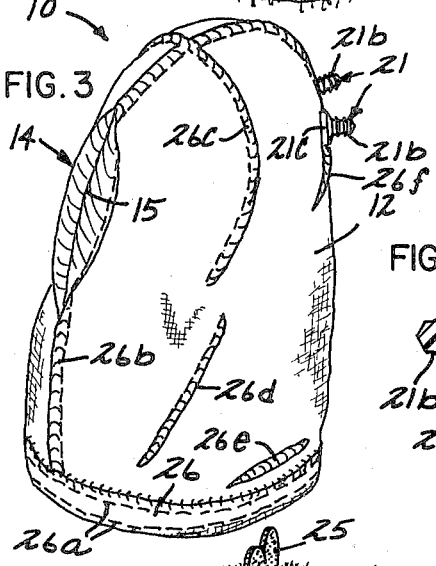
FIG. 3 is a view of the covering of the present invention turned inside out.
Figure 5:
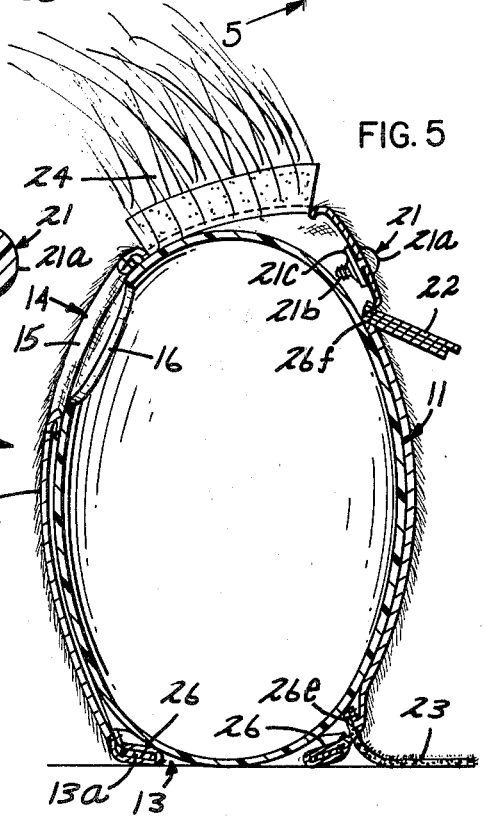
FIG. 5 is a cross-sectional view of the present invention as seen along line 5—5 in FIG. 1.

Referring now to FIG. 3, the covering 12 is shown turned inside out to disclose its construction. The covering 12 is generally made from a rectangular shaped piece of cloth. Two opposing side edges of the piece are sewn together, forming seam **26*b*. An opening 15 is left in the seam 26*b* for purposes discussed in detail below. The head area of the covering is created by sewing a seam 26*c* transversely in the covering to the direction of seam 26*b*, forming thereby a curvature in the covering. The end of the covering opposite the head area is sewn in the following manner to create the elastic opening 13 for the insertion and removal of the container 11 from the covering 12. The entire edge of the open end is turned back along the inside of the covering a small distance to form a hem-like fold 26 as can be partially seen in FIGS. 3 and 5. Within this fold is positioned an elastic, circular member 13*a*. The elastic member 13*a* and the two sides of the fold are then sewn together, securing thereby the elastic member within the covering. The seam 26*a* seen in FIGS. 3 and 4 in broken lines illustrates that the elastic member basically surrounds the opening 13. A row of stitching is then provided along the free edge of the fold 26 to join the fold and the covering in a continuous manner near the opening 13. The final covering shape thus conforms to the egg-shaped coin container 11 so as to encase the container within it. The wings 25 are secured in the covering 12 by seams 26*d*. Other seams 26*e*, 26*f*, and 26*b* secure the feet 23, the beak 22, and the comb, respectively, to the covering, as seen in FIG. 3**. The seams are generally sewn, but they can be glued or otherwise formed in a manner meeting durability and safety requirements.

Figure 6:
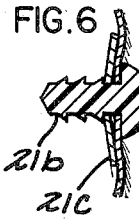
FIG. 6 is a cross-sectional view of an eye attachment of the present invention.

The perspective view in FIG. 3 of the covering 12 turned inside out partially discloses the eye attachment 21. This attachment 21 can be better seen in FIGS. 5 and 6. Each eye attachment 21 is essentially a barb having an exterior portion **21*a* resembling an eye and an interior portion 21*b* for insertion through the covering. The barb becomes fixed in the interior underside of the covering 12 with the aid of a retainer washer 21*c*. The barb portion 21*b* prevents an individual from removing the eye attachment from the covering, and the retainer washer protects the covering from damage by the barb portion 21***b* while maintaining the eye attachment 21 in fixed relation with the covering 12.

Figure 4:
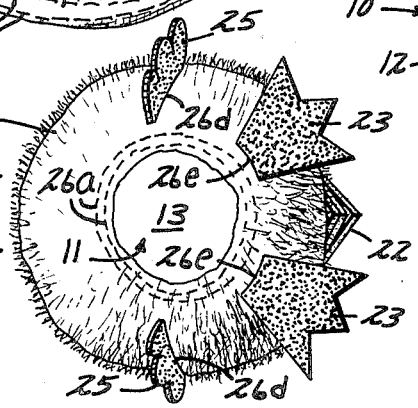
FIG. 4 is a bottom view of the present invention.

The construction of the bottom portion of the coin bank 10 is illustrated in FIG. 4. The coin bank 10 has an adjustable bottom opening 13 which in this embodiment is elasticized and circular in shape. The opening 13 can be stretched or widened sufficiently to allow the egg-like container 11 to be inserted into or removed from the covering 12. The opening 13 self-adjusts after the insertion or removal of the container 11. The opening 13 is provided in the bottom or underside area of the bank in order to symbolize the laying of an egg by the coin bank 10 when the container 11 is removed from the bank.

In the back, neck area of the bird-like bank are the coin passageways 15, 16 which comprise the coin depositing means 14. The covering passageway 15, a narrow slotted area, is formed along the seamline 26*b* of the covering and is only slightly noticeable in an exterior view of the covering. This coin passageway 15 is aligned with the second coin passageway 16 formed, i.e., by cutting, etc., in a portion of the hollow container 11. The second passageway 16 is a circular opening with a diameter large enough to allow the deposited coins to be retrieved from the bank without requiring damage to or breakage of the egg-like container. The passageway 16 is shown in broken lines in FIG. 2.

The coin bank sits upright on the base of the egg-like container 11 with the seams of the adjustable opening 13 aiding the upright positioning. The pair of feet 23 can be made sturdy and rigid enough to cooperate with the covering to insure the bird-like bank remains in the upright position on a surface.

The nature and extent of attachments is not limited to those shown specifically in the preferred embodiment. Numerous variations are possible in order to provide the differing features for any number of birds which may be represented in other embodiments of the present invention in accordance with the scope and provisions of the claims of this invention.

The operation of the present invention should now be obvious. A separate egg-shaped coin container 11 is provided which is encased within a covering 12 resembling an egg-laying bird or animal. Coins are deposited into the bank 10 through a depositing means 14 which includes a passageway 15 provided in the covering 12 aligned with an opening 16 provided in a portion of the container 11. When the bank is either filled or coins are desired to be retrieved from the bank the egg-like container 11 is removed from the covering 12 in the same manner it is inserted into the covering 12, namely, it is forced through the adjustable opening 13 in the bottom portion of the covering 12. After the egg-like container 11 is removed the coins can be retrieved by agitating the container so that each coin is released through the container opening 16.

What is claimed is:

1. A coin bank comprising:

a hollow, oval-shaped container having a solid shell;

an unreinforced fabric covering, said covering being adjacent to said container thereby taking on substantially the form of said container, said covering having an interior volume, said covering extending partially under said container so said container substantially fills the interior volume of said covering, said covering having an adjustable bottom opening permitting said container to be inserted into and removed from said covering;

means for depositing coins through said covering into said container, said depositing means including a second opening in said covering and a third opening in said container, said second and third openings being aligned; and an elastic member about the periphery of said bottom opening, said elastic member for adjusting said bottom opening, for holding said covering in place on said container, and for holding said oval container in an upright position on a surface.

* * * * *